United States Patent [19]

Shimoyashiki et al.

[11] Patent Number: 4,938,662

[45] Date of Patent: Jul. 3, 1990

[54] MECHANICAL PUMP EQUIPMENT

[75] Inventors: Shigehiro Shimoyashiki, Hitachi; Kotaro Inoue, Tohkai; Yojiro Hayashi, Tsuchiura; Yasuo Tachi, Tokyo; Ryuhei Kawabe, Hitachi; Yoshihiko Sato, Tohkai, all of Japan

[73] Assignee: Hitachi, Ltd., Tokyo, Japan

[21] Appl. No.: 415,486

[22] Filed: Oct. 3, 1989

Related U.S. Application Data

[63] Continuation of Ser. No. 137,259, Dec. 23, 1987, abandoned.

[30] Foreign Application Priority Data

Jan. 21, 1987 [JP] Japan ..... 62-9852
Mar. 6, 1987 [JP] Japan ..... 62-50062

[51] Int. Cl.[5] ..... F04D 29/60

[52] U.S. Cl. ..... 415/214.1; 415/913; 376/404

[58] Field of Search ..... 415/214.1, 208.1, 208.2, 415/208.3, 211.1, 211.2, 206, 201, 912, 913; 376/404

[56] References Cited

U.S. PATENT DOCUMENTS

| | | | |
|---|---|---|---|
| 3,467,015 | 9/1969 | Allen | 415/208.3 |
| 3,476,488 | 11/1969 | Chambert | 415/913 |
| 3,910,714 | 10/1975 | Allen et al. | 415/208.3 |
| 4,115,029 | 9/1978 | Florjancic et al. | 415/913 |
| 4,219,385 | 8/1980 | Guidez et al. | 376/404 |
| 4,302,296 | 11/1981 | Sharbaugh et al. | 376/404 |

FOREIGN PATENT DOCUMENTS

| | | | |
|---|---|---|---|
| 178014 | 3/1966 | U.S.S.R. | 415/913 |
| 253993 | 3/1970 | U.S.S.R. | 415/913 |

*Primary Examiner*—Robert E. Garrett
*Assistant Examiner*—John T. Kwon
*Attorney, Agent, or Firm*—Antonelli, Terry, Stout & Kraus

[57] ABSTRACT

Of the components making up the pump, one part including the bearing is removably assembled into the other part so that the bearing is received in the other part. This structure allows easy removal of the first part of the pump components from the second part for disassembly and for maintenance and inspection of the pump. The pump can also be reassembled with ease by inserting the first part into the other part.

10 Claims, 13 Drawing Sheets

MECHANICAL PUMP EQUIPMENT

This application is a continuation of application Ser. No. 137,259, filed on Dec. 23, 1987, now abandoned.

BACKGROUND OF THE INVENTION

The present invention relates to a mechanical pump or more specifically to a pump structure suitable for applications immersed in liquid metal.

Generally, the mechanical pump handling a liquid metal such as liquid sodium is a vertical type centrifugal volute pump with its lower part immersed in the liquid metal.

The pump has a structure in which an impeller is mounted to the lower end of the rotating shaft and a hydrostatic bearing which supports the rotating shaft with the delivery pressure of the sodium is provided above the impeller.

There are two types of mechanical pumps that handle liquid metals: one is a dual casing type as introduced in the U.S. Pat. No. 3,467,015; and the other is a single casing type as disclosed in the U.S. Pat. No. 4,219,385.

In the former type, the inner casing suspends an internal structure including the hydrostatic bearing, suction pipe, diffuser and delivery pipe and the outer casing accommodates the entire internal structure including the rotating shaft and the impeller. The internal structure as a whole can readily be removed out of the casing.

In the latter type, a part of the lower portion of the pump is supported in a vessel independently of an upper structure of the pump. The upper structure includes a large enclosed cylindrical casing, a bearing secured to the casing and a pump shaft supported by the bearing. In the single casing type, the casing which directly supports the bearing cannot be eliminated and should be made strong enough to support the bearing.

The conventional pump has either a single casing or dual casings. Several problems have become evident with these conventional structures.

A few typical problems are described in the following. In the conventional pumps with dual casings, one inside and the other outside, as described in the U.S. Pat. No. 3,467,015, a natural convection causes upward and downward flows of a cover gas (usually a mixture of argon gas and sodium vapor) loaded in an annular gap between the inner casing and the outer casing, producing a temperature distribution along the circumferential direction of the casing. This in turn deforms the casings, giving rise to the possibility that the rotating shaft will contact a member of the pump and be galled, halting the shaft rotation.

The pumps with a structure such as described in the U.S. Pat. No. 4,219,385 have no such problem. But they still have problems common to those pumps with the conventional casings—a heat treatment required to remove strains caused by welding of the casing and an exposure of maintenance workers to radiations. The solution to the former problem requires a large facility for heat treatment. But even with the facility made available a problem still remains that it is difficult to make the large cylindrical casing homogeneous in quality by heat treatment. Moreover, cleaning or decontamination of the internal structure, in which radioactive corrosion products easily collect, cannot effectively be performed because of the presence of the casing. The casing also contributes to increasing the area to which the radioactive corrosion products adhere, and makes disassembly job difficult.

SUMMARY OF THE INVENTION

The object of this invention is to provide a mechanical pump which is compact and highly reliable and has improved work efficiency in disassembly and reassembly.

To achieve the above objective, the first embodiment provides a pump equipment which comprises: an upper structure removably mounted to a vessel; a rotary shaft of the pump penetrating the upper structure and extending down into the liquid contained in the vessel; an impeller mounted to the rotary shaft; a bearing for supporting the rotary shaft at a point above the impeller in at least the radial direction; a bearing block to which the bearing is mounted; a diffuser mounted to the bearing block and disposed opposite to the fluid delivery port of the impeller; and a delivery pipe for leading the fluid coming from the diffuser toward the outside of the pump; whereby the delivery pipe is supported in the vessel independently of the other components of the pump and the bearing block is removably installed in the delivery pipe.

The second embodiment provides a pump equipment which comprises: a first unit and a second unit; the first unit consisting of: a rotary shaft of the pump; an impeller mounted to the rotary shaft; a bearing for supporting the rotary shaft at a point above the impeller; a bearing block to which the bearing is mounted; and a diffuser mounted to the bearing block; the second unit consisting of: a delivery pipe for leading the fluid coming out of the fluid delivery port of the diffuser toward the outside of the pump; whereby the second unit is supported independently of the first unit and the first unit is removably assembled into the second unit.

The third embodiment provides a pump equipment which comprises: a first unit and a second unit; the first unit consisting of: a rotary shaft of the pump penetrating an upper structure; an impeller mounted to the rotary shaft; a bearing for supporting the rotary shaft at a point above the impeller; a bearing block to which the bearing is mounted; and a diffuser mounted to the bearing block; the second unit consisting of: a delivery pipe for leading the fluid coming out of the fluid delivery port of the diffuser toward the outside of the pump; whereby the second unit is supported independently of the first unit, the first unit is removably assembled into the second unit, and the first unit is also connected to the upper structure by support members that are circumferentially spaced from each other.

The fourth embodiment provides a pump equipment which comprises: a first unit and a second unit; the first unit consisting of: a rotary shaft of the pump penetrating an upper structure; an impeller mounted to the rotary shaft; a bearing for supporting the rotary shaft at a point above the impeller; a bearing block to which the bearing is mounted; and a diffuser mounted to the bearing block; the second unit consisting of: a delivery pipe for leading the fluid coming out of the fluid delivery port of the diffuser toward the outside of the pump; whereby the second unit is supported independently of the first unit, the first unit is removably assembled into the second unit, and the first unit is also connected to the upper structure by a support member that has a fluid passage.

The fifth embodiment provides a pump equipment which comprises: a first unit and a second unit; the first unit consisting of: a rotary shaft of the pump; an impeller mounted to the rotary shaft; a bearing for supporting the rotary shaft at a point above the impeller; a bearing block to which the bearing is mounted; and a diffuser mounted to the bearing block; the second unit consisting of: a delivery pipe for leading the fluid coming out of the fluid delivery port of the diffuser toward the outside of the pump; whereby the second unit is supported independently of the first unit, the first unit is removably assembled into the second unit, and the end surface of the fluid delivery port of the diffuser is inclined outwardly toward the top.

The sixth embodiment provides a pump equipment which comprises: a first unit and a second unit; the first unit consisting of: a rotary shaft of the pump; an impeller mounted to the rotary shaft; a bearing for supporting the rotary shaft at a point above the impeller; a bearing block to which the bearing is mounted; and a diffuser mounted to the bearing block; the second unit consisting of: a delivery pipe for leading the fluid coming out of the fluid delivery port of the diffuser toward the outside of the pump; whereby the second unit is supported independently of the first, the first unit is removably assembled into the second unit, and a sealing structure is provided in a very small gap formed between the opposing surfaces of the two units.

The seventh embodiment provides a pump equipment which comprises: a first unit and a second unit; the first unit consisting of: a rotary shaft of the pump penetrating an upper structure; an impeller mounted to the rotary shaft; a bearing for supporting the rotary shaft at a point above the impeller; and a bearing block to which the bearing is mounted; the second unit consisting of: a diffuser for accepting the fluid from the fluid delivery port of the impeller; and a delivery pipe for leading the fluid coming out of the fluid delivery port of the diffuser toward the outside of the pump; whereby the second unit is supported independently of the first unit, the first unit is removably assembled into the second unit, and the first unit is also connected to the upper structure by support members that are circumferentially spaced from each other.

The eighth embodiment provides a pump equipment which comprises: a first unit and a second unit; the first unit consisting of: a rotary shaft of the pump penetrating an upper structure; an impeller mounted to the rotary shaft; a bearing for supporting the rotary shaft at a point above the impeller; and a bearing block to which the bearing is mounted; the second unit consisting of: a diffuser for accepting the fluid from the fluid delivery port of the impeller; and a delivery pipe for leading the fluid coming out of the fluid delivery port of the diffuser toward the outside of the pump; whereby the second unit is supported independently of the first unit, the first unit is removably assembled into the second unit, and the first unit is also connected to the upper structure by a support member that has a fluid passage.

The ninth embodiment provides a pump equipment which comprises: a first unit and a second unit; the first unit consisting of: a rotary shaft of the pump penetrating an upper structure; an impeller mounted to the rotary shaft; a bearing for supporting the rotary shaft at a point above the impeller; and a bearing block to which the bearing is mounted; the second unit consisting of: a diffuser for accepting the fluid from the fluid delivery port of the impeller; and a delivery pipe for leading the fluid coming out of the fluid delivery port of the diffuser toward the outside of the pump; whereby the second unit is supported independently of the first unit and the first unit is removably assembled into the second unit.

The tenth embodiment provides a pump equipment which comprises: a first unit and a second unit; the first unit consisting of: a rotary shaft of the pump penetrating an upper structure; an impeller mounted to the rotary shaft; a bearing for supporting the rotary shaft at a point above the impeller; and a bearing block to which the bearing is mounted; the second unit consisting of: a diffuser for accepting the fluid from the fluid delivery port of the impeller; and a delivery pipe for leading the fluid coming out of the fluid delivery port of the diffuser toward the outside of the pump; whereby the second unit is supported independently of the first unit, the first unit is removably assembled into the second unit, fluid turbulence prevention plates are radially arranged around the rotary shaft with a gap between the shaft and the plates and are circumferentially spaced from each other, and the fluid turbulence prevention plates are also supported by a stationary structure.

DESCRIPTION OF THE PREFERRED EMBODIMENTS

Figure 1:
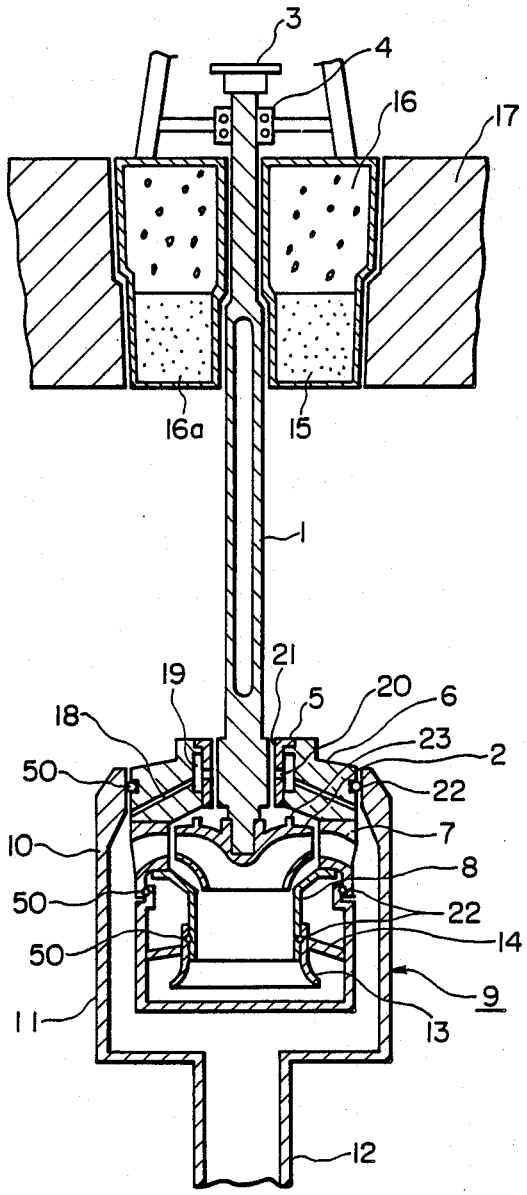
FIG. 1 is a cross section showing the fundamental structure of the mechanical sodium pump constituting the first embodiment of the invention.

The first embodiment of this invention will now be described by referring to FIGS. 1 through 6.

Reference numeral 1 denotes a rotating shaft of the pump and 2 an impeller rigidly secured to the shaft 1. At the upper end of the shaft 1 is a coupling 3 which is connected to a drive motor (not shown).

The rotary shaft 1 is supported by an oil-lubricated ball bearing 4 provided under the coupling 3 and a sodium-lubricated hydrostatic bearing 5 provided above the impeller 2.

The hydrostatic bearing 5 is securely mounted to a bearing block 6 of the pump. Under the bearing block 6 is a diffuser 7, to the under-surface of which is secured a straight suction pipe 8 (hereafter referred to simply as a suction pipe 8). These three members are bolted or welded together to form an upper unit.

A lower unit is made up of a delivery pipe of the pump and a bell-mouth-shaped suction pipe 13 (hereafter referred to simply as a bell mouth 13) secured to the delivery pipe through a rib 14. The delivery pipe 9 consists of a ring-shaped seal block 10 at the top and contiguous pipe portions 11 and 12. The ring 10 is open at the upper end so that the upper unit including the hydrostatic bearing 5 can be inserted into the ring portion 10.

Figure 5:
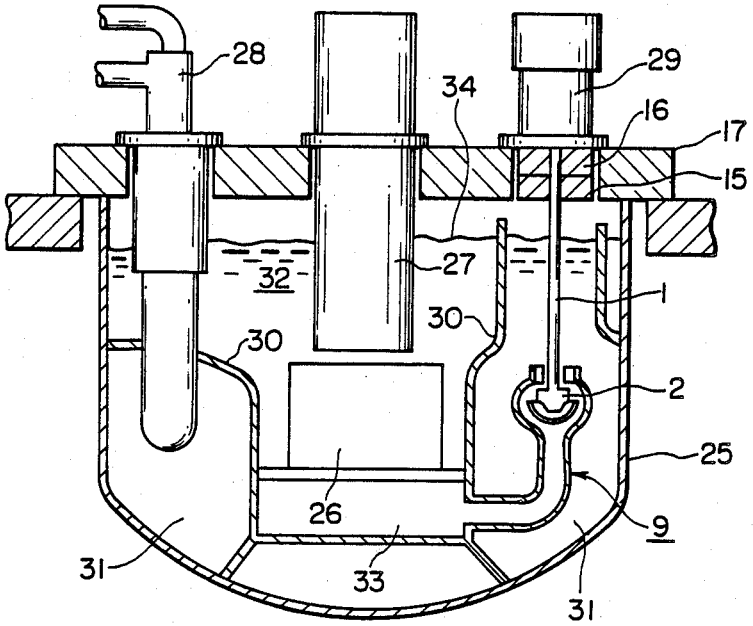
FIG. 5 is a schematic cross section showing one example of a tank type fast breeder reactor to which the pump of FIG. 1 is applied.
Figure 6:
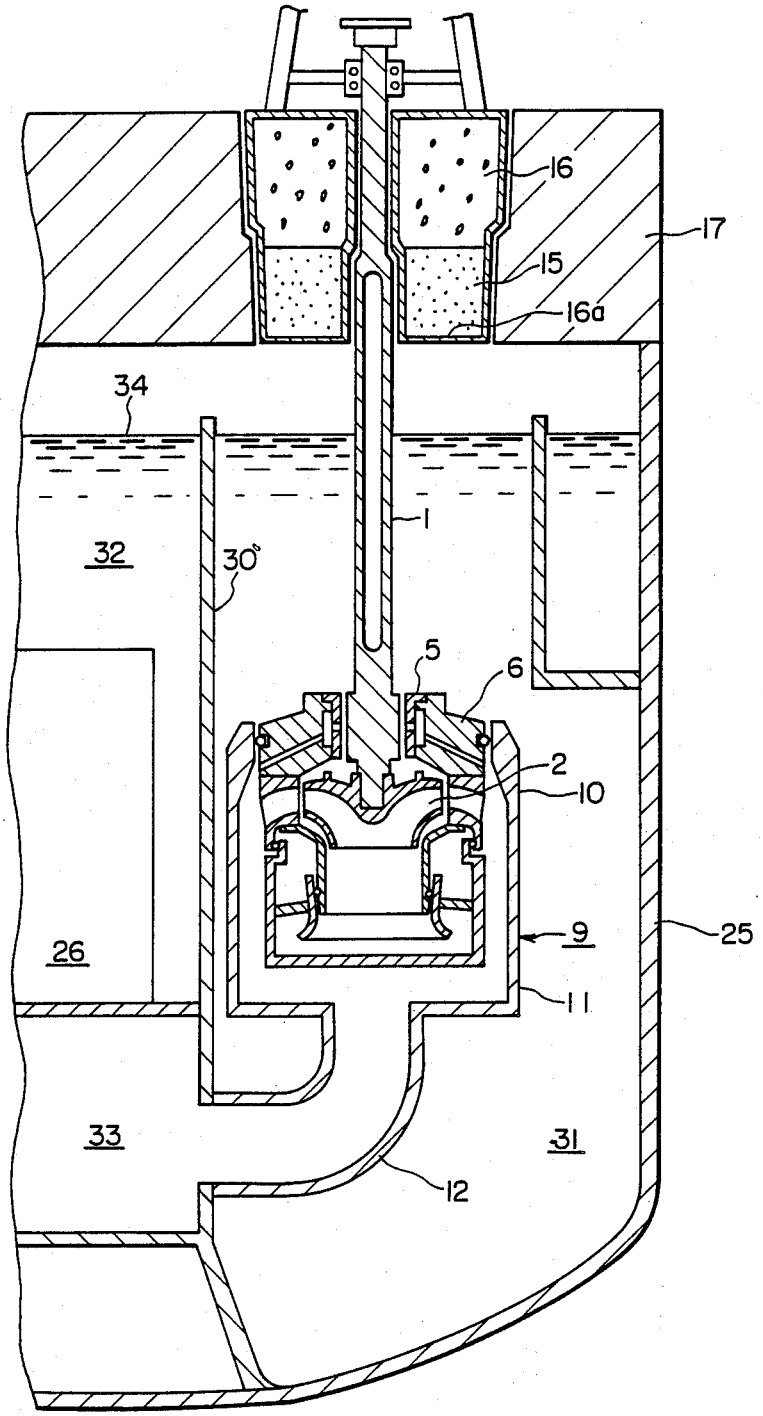
FIG. 6 is a cross section showing the detail of the pump and its associated structure of FIG. 5.

The pipe portion 12 of the delivery pipe 9 generally is secured to a sodium flow pipe or a vessel, as shown in FIGS. 5 and 6.

The bell mouth 13 has the suction pipe 8 inserted therein for secure holding and guides the fluid into the inlet of the impeller.

Provided above the pump are a heat shielding 15 and a living body protection shielding 16. The shieldings 15, 16 are enclosed by an outer hull plate 16*a* to form an upper structure, through which the rotating shaft 1 passes. Reference numeral 17 represents a roof slab provided over the reactor which serves as a cover of the reactor vessel. The upper structure is removably mounted to the roof slab 17.

The mechanical sodium pump generally has a long rotating shaft and therefore has an inherent problem of vibration that may be caused by rotation. Hence the bearing must be rigidly supported. This can be realized in this invention by inserting the suction pipe 8 into the bell mouth 13 and also inserting the bearing block 6 and diffuser 7 into the seal block 10 of the delivery pipe 9.

Now, we will explain the operation of the pump. As the shaft 1 is rotated by the drive motor, the impeller 2 rotates with the shaft 1. This causes the sodium to be drawn into the bell mouth 13 and the suction pipe 8. The sodium is pressurized by the impeller 2 and the diffuser 7 and then discharged out of the pump through the delivery pipe 9. A part of the sodium pressurized by the diffuser 7 passes through a passage 18 formed in the bearing block 6 into a pocket 19, from which it further moves through a hole 20 in the hydrostatic bearing 5 to the bearing surface 21. The pressurized sodium keeps a specified static pressure in the gap between the bearing surface and an opposing rotating shaft surface and thereby supports the rotating shaft 1.

Where the bearing block 6 and the diffuser 7 are inserted into the delivery pipe 9 and where the suction pipe 8 is inserted into the bell mouth 13, a groove 22 is formed in the bearing block 6, diffuser 7 and suction pipe 8. In each of these grooves 22 is installed a seal ring 50 to prevent sodium leakage from the coupling portion of the upper and lower units.

Next, we will explain the steps for assembling the hydrostatic bearing, impeller and their associated components. First, the hydrostatic bearing 5 mounted to the bearing block 6 is sleeved over the shaft 1, to which the impeller 2 is then mounted. Next, the diffuser 7 is mounted to the bearing block 6. Lastly, the suction pipe 8 is secured to the diffuser 7. The bearing block 6 is held and suspended by the projection 23 of the impeller 2 and is lowered into the delivery pipe 9 with the suction pipe 8 inserted into the bell mouth 13. This insertion job is easily done because the outer peripheral surface of the diffuser 7 is formed inclined as shown in FIG. 1. The suction pipe 8 is inserted into the bell mouth 13 for rigid connection by pushing the impeller 2 against the suction pipe 8.

This allows upper and lower units to be put in their correct positional relationships and securely held together. The bearing block 6 and diffuser 7, installed in the delivery pipe 9, are slidable relative to the delivery pipe 9 although the radial gap between the upper unit and the delivery pipe 9 is small. This slidable portion absorbs the difference in thermal expansion between the upper and lower units.

When the pump is to be disassembled, the bearing block 6 is supported by the projection 23 of the impeller 2 to lift the upper unit. Then the upper unit is disassembled for cleaning by reversing the assembly procedure.

Positioning of the impeller 2 during assembly is done by first seating the impeller 2 on the suction pipe 8 and then lifting the shaft a predetermined distance.

Figure 2:
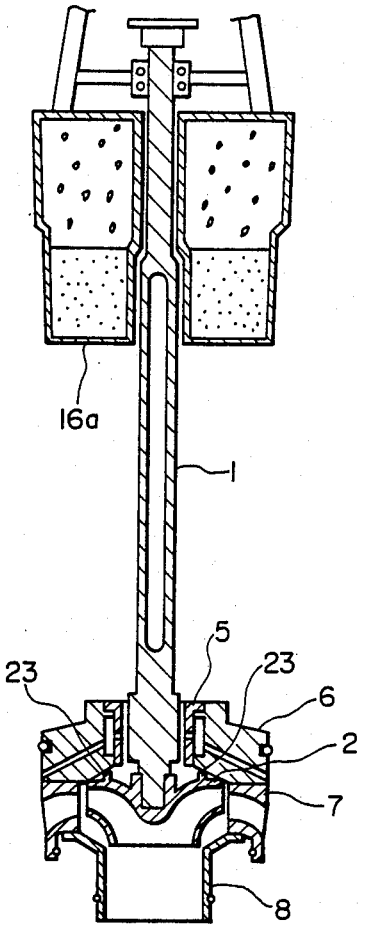
FIG. 2 is a cross section showing a hydrostatic bearing assembly removed from the delivery pipe and bell mouth in the structure of FIG. 1.

FIG. 2 illustrates the pump pulled out of the delivery pipe 9. Only the upper unit and the associated components—including the shaft 1, impeller 2 and hydrostatic bearing 5—are lifted, with the lower unit left inside the reactor vessel, to pull out the rotating part and bearing requiring maintenance and inspection.

Figure 3:
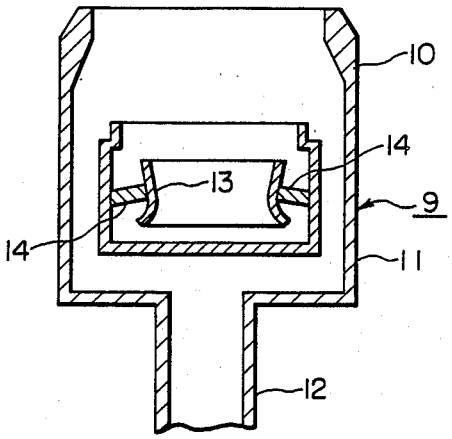
FIG. 3 is a cross section showing the detail of the delivery pipe and bell mouth in the structure of FIG. 1.
Figure 4:
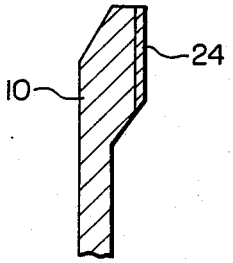
FIG. 4 is a cross section showing the surface hardening material clad over the upper metal portion in the structure of FIG. 3.

FIG. 3 shows the detail of the delivery pipe 9 and the bell mouth 13. The metal surface of the delivery pipe 9 where the upper unit is inserted is clad, as by flame spraying, with a surface hardening material 24 which has good compatibility with the sodium, as shown in FIG. 4. This surface hardening treatment is done to prevent wearing or galling of the delivery pipe 9 when the upper unit is pulled or inserted and to prevent the self-fusing of the unit after a long period of service.

FIG. 5 shows one example of a tank type fast breeder reactor to which the pump of FIG. 1 is applied.

In FIG. 5, reference numeral 25 represents a reactor vessel, 26 a reactor core, 27 a refueling machine, 28 an intermediate heat exchanger, and 29 a pump. Reference numeral 30 denotes a heat insulating wall separating a low-temperature plenum 31 and a high-temperature plenum 32. FIG. 6 shows the detail of the part of FIG. 5 where the pump is installed. The delivery pipe 9 is connected to an inlet plenum 33 that forms an inlet of the reactor core 26, and is secured to the heat insulating wall 30.

With reference to FIG. 5, the flow of sodium is explained. The sodium in the low-temperature plenum 31 is drawn by the impeller 2 through the delivery pipe 9 into the inlet plenum 33. The sodium then passes through the reactor core 26 where it is heated and then enters the high-temperature plenum 32, from which it further flows into the intermediate heat exchanger 28. The sodium cooled at the heat exchanger 28 now returns to the low-temperature plenum 31. 34 indicates the level of the sodium.

Figure 7:
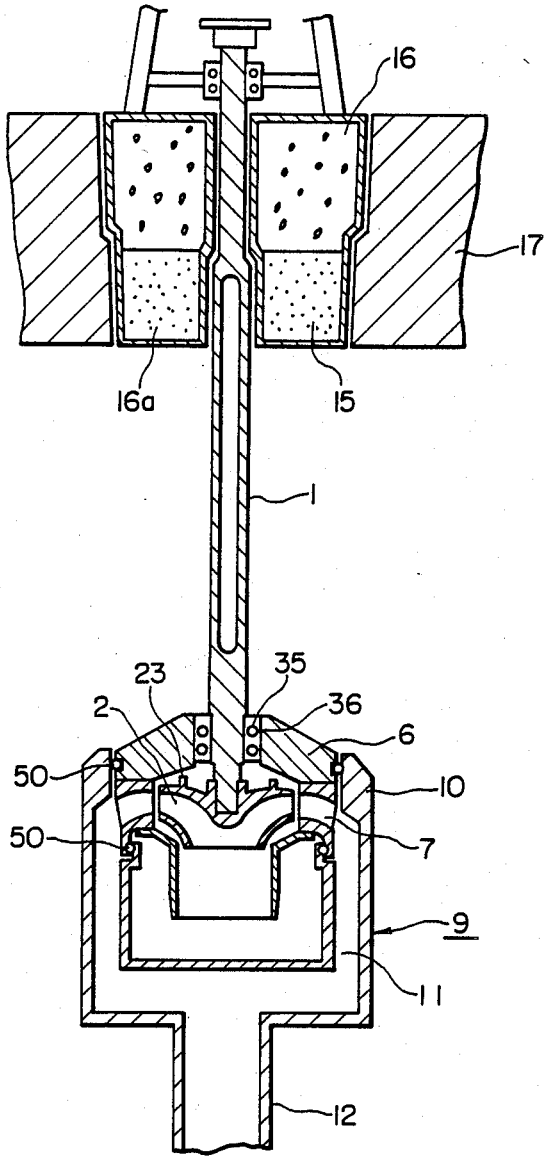
FIG. 7 is a vertical cross section of a mechanical sodium pump as the second embodiment of the invention.

FIG. 7 shows the second embodiment of this invention. In this embodiment, a ball bearing 35 is used in place of the sodium-lubricated bearing located above the impeller 2. The ball bearing has the advantage of being able to be reduced in size as compared with the static pressure bearing 5 used in the pump of FIG. 1. This allows reduction in the size of the bearing block 6 and the seal block 10 that accommodates the bearing block 6, which in turn contributes greatly to reducing the weight of the pump as a whole. The sodium is low in viscosity and is hardly effective as the lubricating agent for the ball bearing. Hence, the balls 36 of the ball bearing should be made from material which has good compatibility with hot sodium, such as carbide of nickel alloy or ceramics. The use of the ball bearing 35 renders unnecessary a sodium supply passage 18 in the bearing block 6 which is required by the hydrostatic bearing 5.

In this embodiment, the structure is made as simple as possible. The bell mouth 13 is eliminated and the lower end of the diffuser 7 is received by the L-shaped upper end of the delivery pipe 9 so as to help position the upper unit. The other parts are the same as those of the first embodiment of FIG. 1.

The suction pipe 8 shown in FIG. 7 may be in the form of a bell mouth, in which case the suction pipe will have smaller vibrations and therefore a higher suction efficiency.

Figure 8:
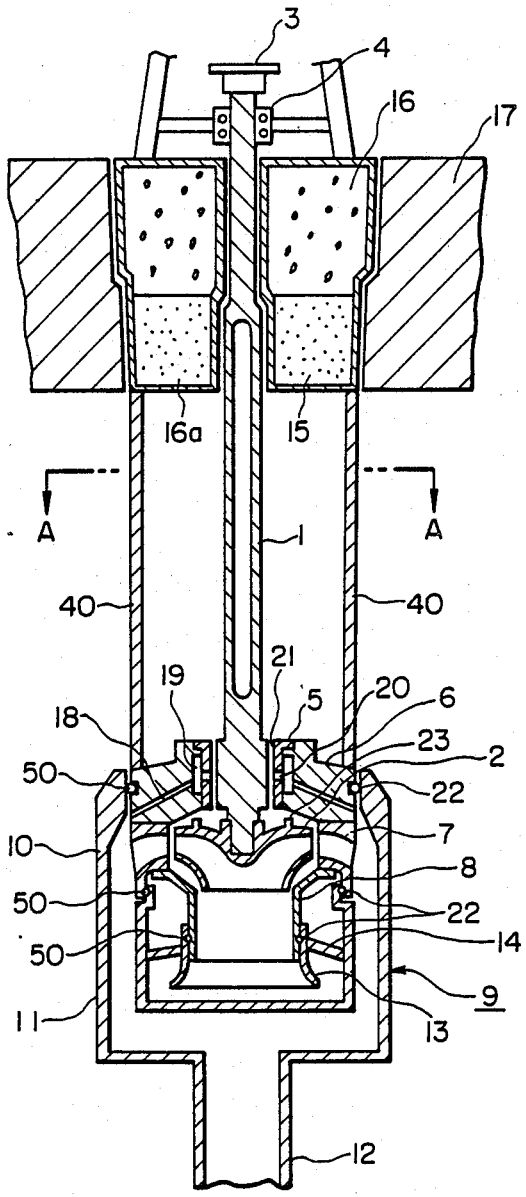
FIG. 8 is a vertical cross section of a mechanical sodium pump as the third embodiment of the invention.
Figure 9:
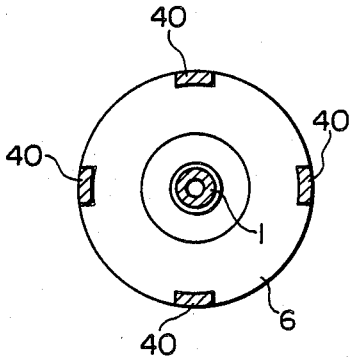
FIG. 9 is a cross section taken along the line A—A of FIG. 8.

In the third embodiment shown in FIGS. 8 and 9, four stays 40 or support members equidistantly spaced in circumferential direction to define a fluid passage connect the bearing block 6 and the outer hull plate 16*a*—which forms the upper structure—to support the bearing block 6 from the shieldings 15, 16. The other parts are the same as those of the first embodiment of FIG. 1.

With the third embodiment, it is possible to reinforce the bearing support structure without employing a large cylindrical casing.

Figure 10:
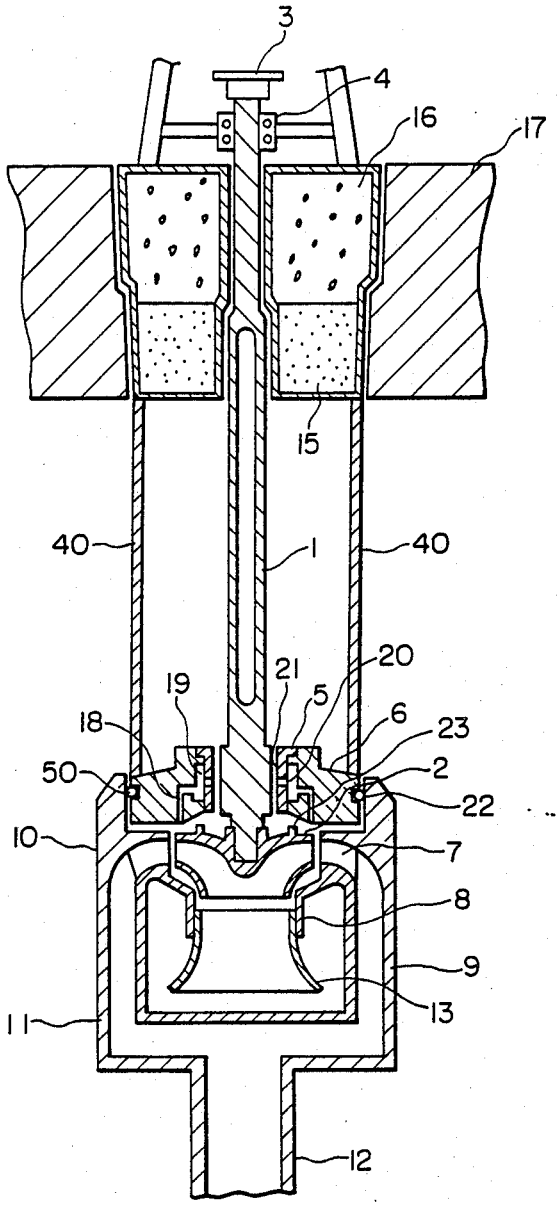
FIG. 10 is a vertical cross section of a mechanical sodium pump as the fourth embodiment- of the invention.

The fourth embodiment shown in FIG. 10 has the diffuser 7 rigidly secured to the delivery pipe 9 and separated from the bearing block 6. The suction pipe 8, bell mouth 13 and diffuser 7 are formed as one assembly and securely fixed to the delivery pipe 9 to form the lower unit. The outer hull plate 16*a* and the bearing block 6 are connected with each other by the four stays 40 defining a fluid passage therebetween. The construction in other respects is similar to that of FIG. 8.

In the fourth embodiment, the number of components making up the upper unit is smaller than that of the third embodiment, so that the various jobs such as disassembly, reassembly, maintenance and inspection, and cleaning can be done more easily.

Figure 11:
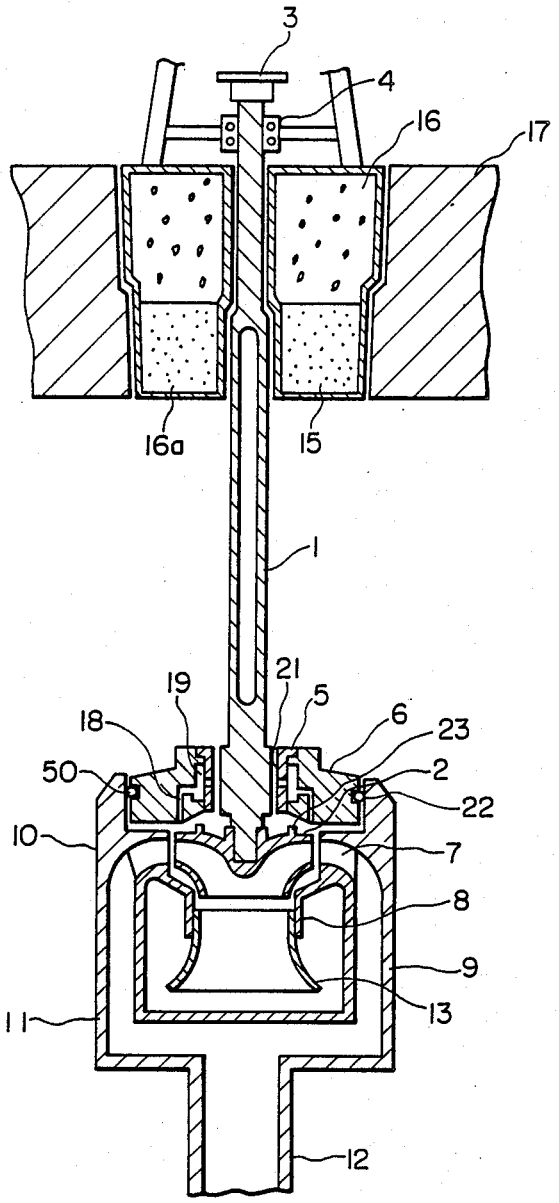
FIG. 11 is a vertical cross section of a mechanical sodium pump as the fifth embodiment of the invention.

The fifth embodiment in FIG. 11 has eliminated all the four stays 40 that are used in the fourth embodiment of FIG. 10. The other parts are the same as those of the fourth embodiment.

In the fifth embodiment, since the number of components making up the upper unit is smaller, as with the fourth embodiment, and the weight to be lifted for maintenance is also smaller, the weight of the upper unit is sustained by the shaft 1 when the upper unit is pulled out of or inserted into the lower unit. The removal and insertion work is done more easily than with the fourth embodiment because there are no stays 40. The use of ball bearing 35 of FIG. 7 in place of the bearing 5 will result in a very light and small upper unit facilitating maintenance and services associated with the pump.

Figure 12:
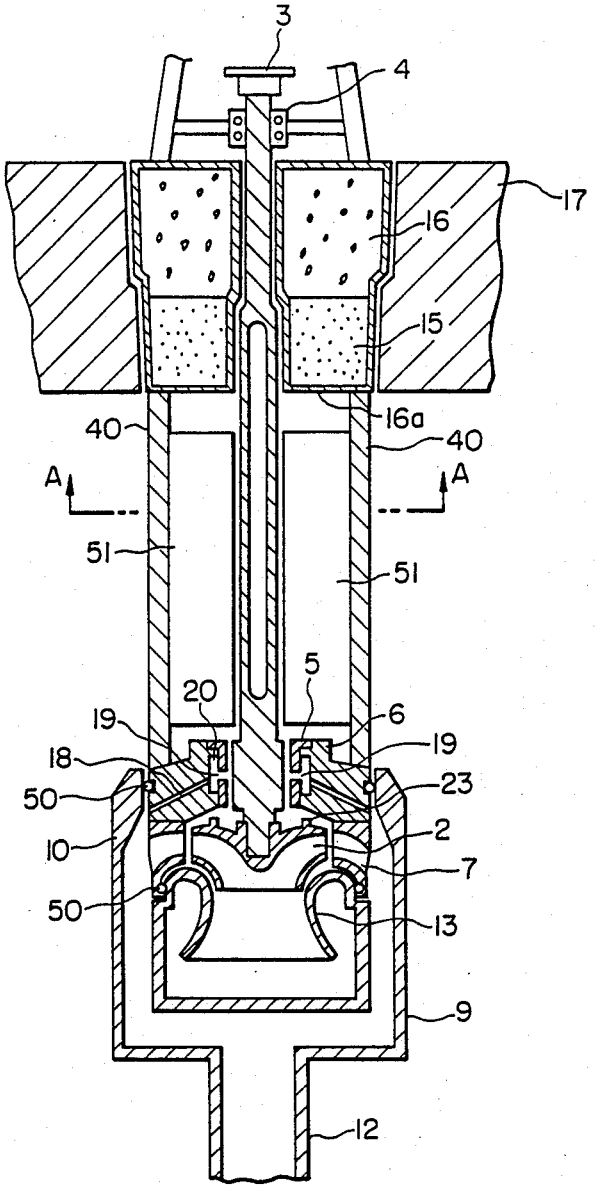
FIG. 12 is a vertical cross section of a mechanical sodium pump as the sixth embodiment of the invention.
Figure 13:
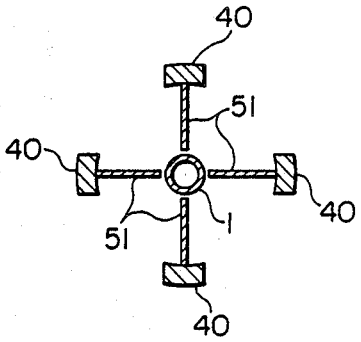
FIG. 13 is cross section taken along the line A—A of FIG. 12.

The sixth embodiment of FIGS. 12 and 13 is a variation of the third embodiment. The major changes are that the bell mouth 13 is formed integral with the upper portion of the delivery pipe 9; that the suction pipe 8 is eliminated; and that fluid turbulence prevention plates 51 are provided, each of which has its one end surface disposed close to the rotating shaft 1 and the other end surface secured to each of the stays 40. The turbulence prevention plates 51 need not be fixed to the stays but instead may be secured to the bearing block 6 or to the outer hull plate 16*a* or both.

Figure 17:
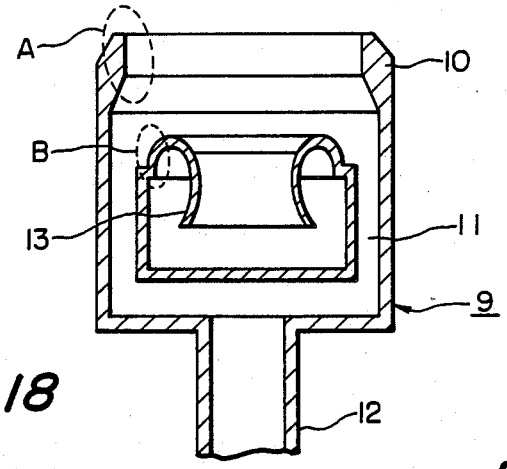
FIG. 17 is a vertical cross section showing the lower unit of the sixth embodiment.
Figure 18:
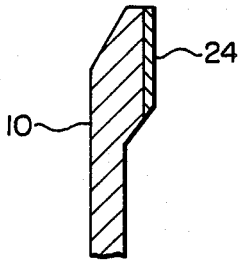
FIG. 18 is a partial enlarged cross section showing the part A of FIG. 17.
Figure 19:
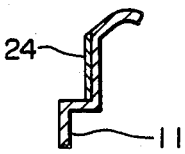
FIG. 19 is a partial enlarged cross section showing the part B of FIG. 17.
Figure 21:
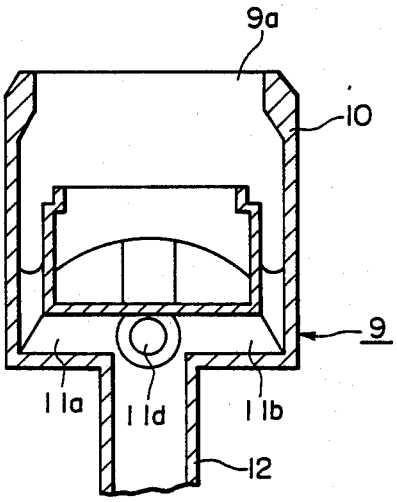
FIG. 21 is a vertical cross section showing a variation of the lower unit of the pump according to the invention.
Figure 22:
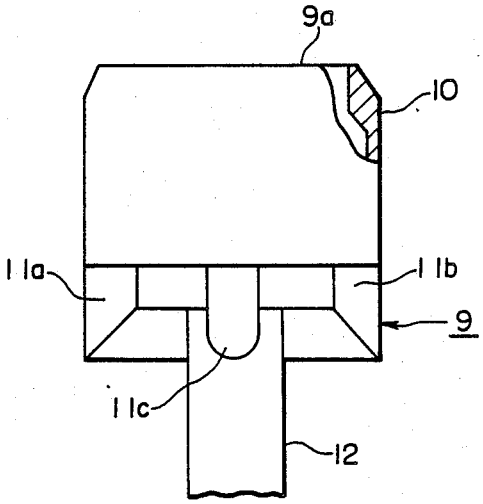
FIG. 22 is an external view, partially cut away, of the lower unit of FIG. 21.

In this embodiment, the fluid around the shaft 1 is prevented by the turbulence prevention plates 51 from moving along the rotating shaft 1, thereby preventing the occurrence of a vortex around the shaft. The lower unit has a cross section as shown in FIG. 17 and, at parts "A" and "B", are coated with a surface hardening material 24 as shown in FIGS. 18 and 19 because the lower unit is contact at these parts with the upper unit through the seal members. In FIG. 17, the bell mouth 13 may be in the form of straight suction pipe but a bell mouth shape will ensure a higher suction efficiency and smaller vibration.

Figure 16:
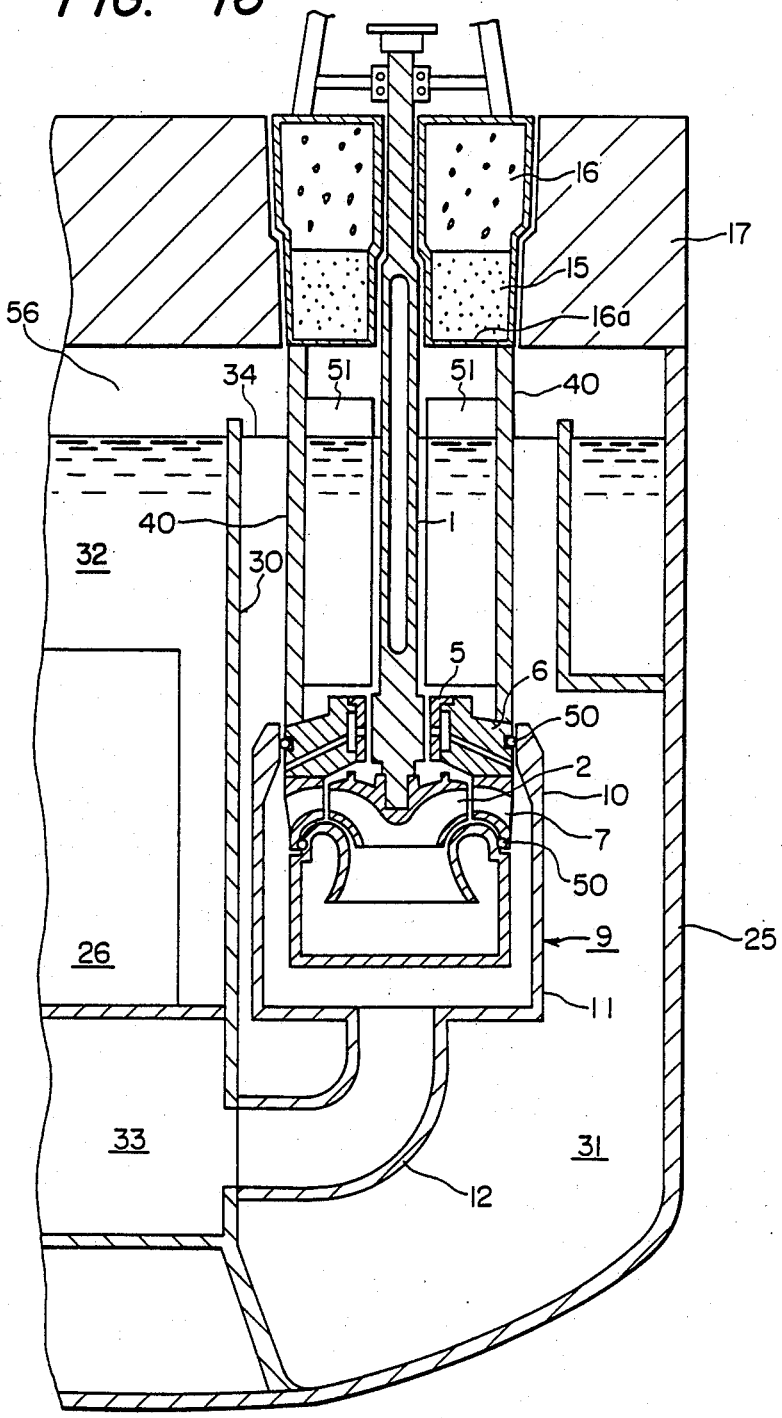
FIG. 16 is a vertical cross section of the seventh embodiment of the invention showing an essential part of a tank type fast breeder reactor to which the mechanical sodium pump of the sixth embodiment is applied.

FIG. 16 shows the seventh embodiment in which the pump of the sixth embodiment is applied to the tank type fast breeder reactor.

As with the previous embodiment shown in FIGS. 5 and 6, the pipe portion 12 of the delivery pipe 9 is secured to the heat insulating wall 30 which divides the reactor vessel 25 containing sodium into the low-temperature plenum 31 and the high-temperature plenum 32—to connect the delivery pipe 9 to the inlet plenum 33 located under the reactor core 26. In this way, the pipe portion 12 is secured to the structure in the reactor vessel to rigidly support the lower unit of the pump in the vessel. The upper unit of the pump is inserted into the rigidly supported lower unit and is enclosed within the reactor vessel by installing the heat shielding 15 and the living body protection shielding 16 in the roof slab 17 that forms a part of the reactor vessel. In this condition, upper parts of the turbulence prevention plates 51 rise above the sodium level 34 into the space of cover gas 56. The upper exposed parts in the cover gas of the turbulence prevention plates 51 prevent the cover gas from being swirled by the rotating shaft 1 and developing into a vortex.

Figure 14:
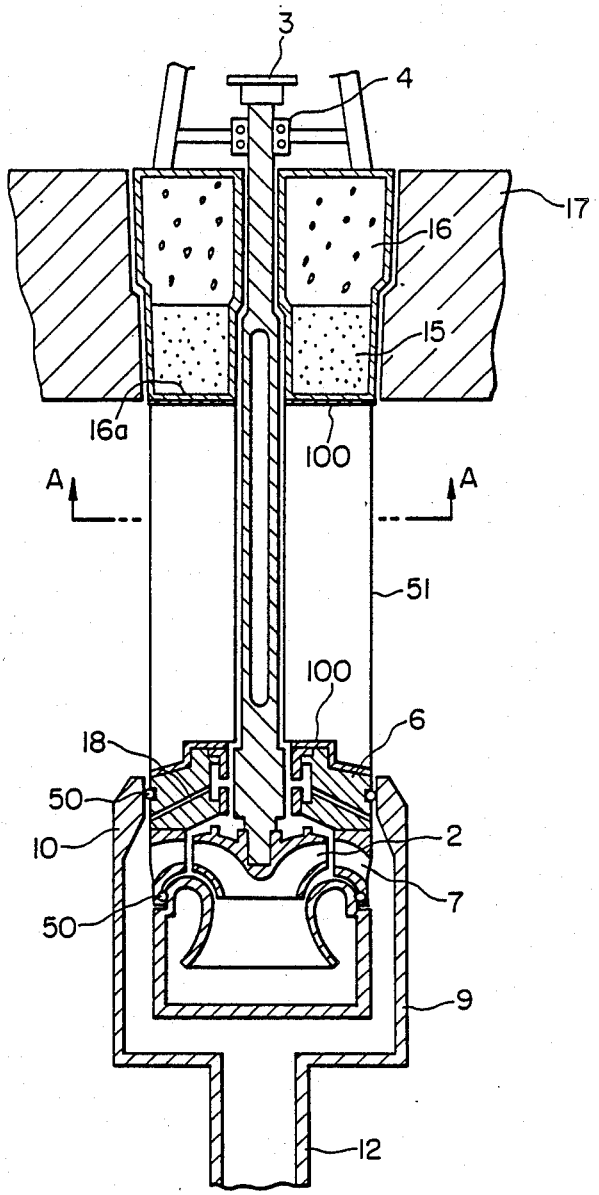
FIG. 14 is a vertical cross section of a mechanical sodium pump as the eighth embodiment of the invention.
Figure 15:
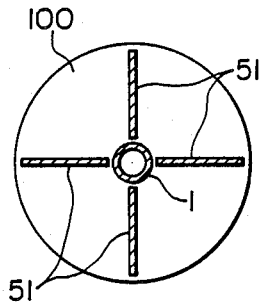
FIG. 15 is a cross section taken along the line A—A of FIG. 14.

The eighth embodiment shown in FIGS. 14 and 15 is a modification to the sixth embodiment. The major changes are that the stays 40 are eliminated and the turbulence prevention plates 51 are used to connect the shieldings 15, 16 and the bearing block 6. The upper ends of the turbulence prevention plates 51 are secured to a support plate 100 fixed to the outer hull plate 16*a* and the lower ends of the plates 51 are secured to a support plate 100 which in turn is fixed on the upper surface of the bearing block 6.

This embodiment is advantageous over the sixth embodiment in that it is lighter and can prevent the occurrence of swirling vortex of fluid that might otherwise be caused by the rotation of the shaft 1.

Figure 20:
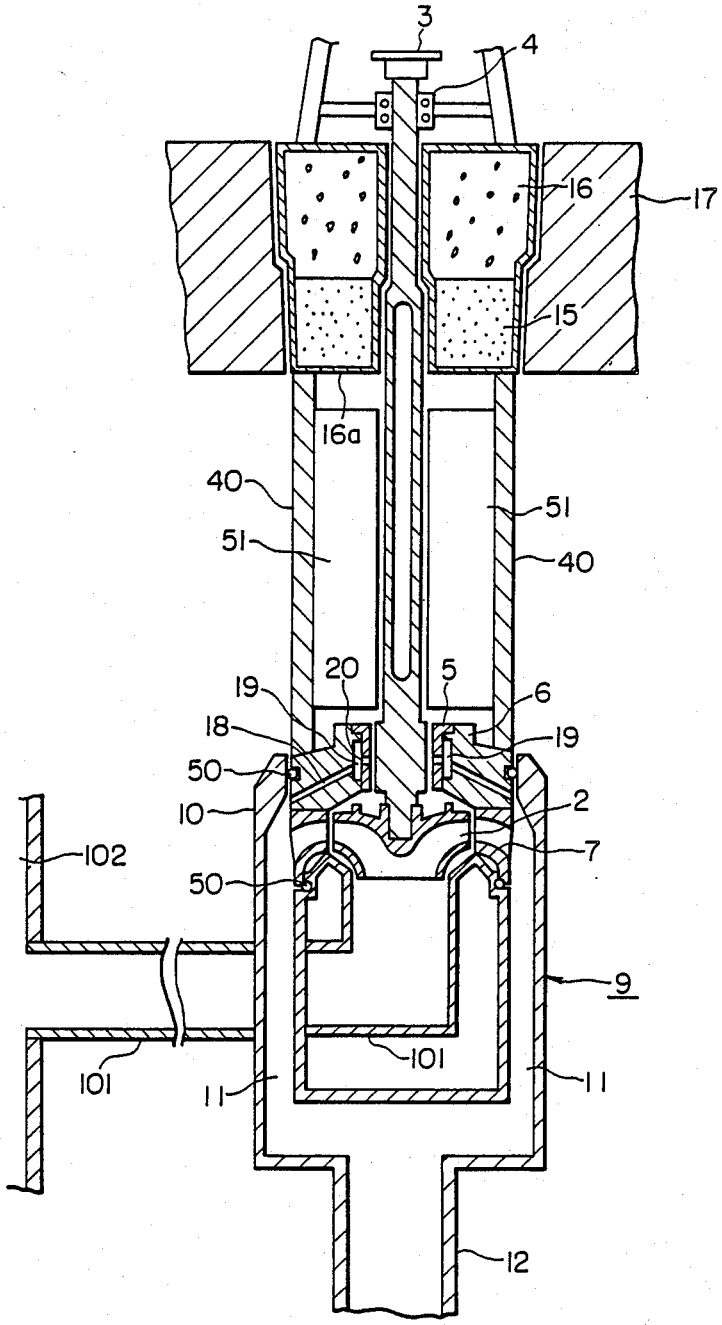
FIG. 20 is a vertical cross section showing a mechanical sodium pump as the ninth embodiment of the invention.

In the preceding embodiments, the lower end of the suction pipe 8 or bell mouth 13 is open almost immediately beneath the impeller 2. However, as shown in the ninth embodiment of FIG. 20, it is also possible to use a suction communicating pipe 101 which is formed by extending the suction pipe and that directly communicates with the region 102 where the fluid to be drawn is contained.

As to the lower unit of the pump, the pipe portion 12 may be branched into smaller pipes 11*a*, 11*b*, 11*c*, 11*d* that connect to the upper delivery pipe portion 9*a* which has the seal block 10 at the top. In this case, the fluid pumped out of the diffuser is led into the upper delivery pipe portion 9*a*, from which the fluid branches into the four branch pipes 11*a* to 11*d* and then merges into the pipe 12 to be delivered toward the desired direction. The branch pipes 11*a* to 11*d* may be other than four in number.

In either of the foregoing embodiments, the enclosed cylindrical casing of the pump can be eliminated and this in turn provides the following advantages.

(1) The size and weight of the pump can be reduced.

(2) The shaft galling troubles will significantly be reduced since the pump is free from the casing deformation problem.

(3) The pump diameter can be reduced.

(4) The area to which radioactive corrosion products adhere becomes smaller than that of the conventional pump, reducing the amount of radioactive corrosion product buildups.

(5) The number of manufacturing processes is reduced as the welding, heat treatment and machining of the casing is eliminated.

(6) Disassembly and reassembly of the pump are easily done. Particularly the cleaning and disassembly of the pump contaminated with radioactive corrosion products become easy and this significantly reduces the risk of radiation positioning of workers during maintenance.

(7) Smaller diameter of the pump allows the through hole in the roof slab at the top of the reactor to be made smaller, which in turn reduces the diameter of the reactor vessel.

As stated above, this invention offers a pump equipment which is compact and has high reliability and improved work efficiency in disassembly and reassembly.

We claim as our invention:

1. A pump system comprising: an upper structure removable with respect to a vessel; a rotary shaft of the pump passing through the upper structure and freely extending down into the liquid contained in the vessel; an impeller mounted to the rotary shaft; a bearing for supporting the rotary shaft at a point above the impeller in at least the radial direction; a bearing block to which the bearing is mounted; a diffuser mounted to the bearing block and disposed opposite to the fluid delivery port of the impeller; and a delivery pipe for leading the fluid coming out of the diffuser toward the outside of the pump whereby; the delivery pipe is supported in the vessel independently of the other components of the pump, the diffuser and delivery pipe are supported at a position lower than the rotary shaft and the bearing block is removably installed in the delivery pipe such that lateral vibration of the bearing is supported by the diffuser and delivery pipe.

2. A pump system comprising: a first unit and a second unit; the first unit consisting of: a pump rotary shaft free of a continuous surrounding casing; an impeller mounted to the rotary shaft; a bearing for supporting the rotary shaft at a point above the impeller; a bearing block to which the bearing is mounted; and a diffuser mounted to the bearing block; the second unit consisting of: a delivery pipe for leading the fluid coming out of the fluid delivery port of the diffuser toward the outside of the pump; whereby the second unit is supported independently of the first unit at a position lower than the rotary shaft and the first unit is removably assembled into the second unit such that lateral vibration of the bearing block is supported by the second unit.

3. A pump system comprising: a first unit and a second unit; the first unit consisting of: a rotary shaft of the pump penetrating an upper structure and extending toward the second unit freely in the absence of a continuous surrounding wall; and impeller mounted to the rotary shaft; a bearing for supporting the rotary shaft at a point above the impeller; a bearing block to which the bearing is mounted; and a diffuser mounted to the bearing block; the second unit consisting of: a delivery pipe for leading the fluid coming out of the fluid delivery port of the diffuser toward the outside of the pump, whereby the second unit is supported independently of the first unit at a position lower than the rotary shaft, the first unit is removably assembled into the second unit such that lateral vibration of the bearing block is supported by the second unit, and the first unit is also connected to the upper structure by circumferentially spaced support members providing a fluid passage.

4. A pump system comprising: a first unit and a second unit; the first unit consisting of: a rotary shaft of the pump penetrating an upper structure and extending toward the second unit freely in the absence of a continuous surrounding surface; an impeller mounted to the rotary shaft; a bearing for supporting the rotary shaft at a point above the impeller; a bearing block to which the bearing is mounted; and a diffuser mounted to the bearing block; the second unit consisting of: a delivery pipe for leading the fluid coming out of the fluid delivery port of the diffuser toward the outside of the pump; whereby the second unit is supported independently of the first unit at a position lower than the rotary shaft, the first unit is removably assembled into the second unit such that lateral vibration of the bearing block is supported by the second unit, and the first unit is also connected to the upper structure by at least one support member defining a fluid passage.

5. A pump system comprising: a first unit and a second unit; the first unit consisting of: a pump rotary shaft free of a continuous surrounding surface; an impeller mounted to the rotary shaft; a bearing for supporting the rotary shaft at a point above the impeller; a bearing block to which the bearing is mounted; and a diffuser mounted to the bearing block; the second unit consisting of: a delivery pipe for leading the fluid coming out of the fluid delivery port of the diffuser toward the outside of the pump; whereby the second unit is supported independently of the first unit at a position lower than the rotary shaft, the first unit is removably assembled into the second unit such that lateral vibration of the bearing block is supported by the second unit, and an end surface of the fluid delivery port of the diffuser is inclined outwardly toward the first unit.

6. A pump system comprising: a first unit and a second unit; the first unit consisting of: a pump rotary shaft having no continuous surrounding wall; an impeller mounted to the rotary shaft; a bearing for supporting the rotary shaft at a point above the impeller; a bearing block to which the bearing is mounted; and a diffuser mounted to the bearing block; the second unit consisting of: a delivery pipe for leading the fluid coming out of the fluid delivery port of the diffuser toward the outside of the pump; whereby the second unit is supported independently at a position lower than the rotary shaft of the first unit, the first unit is removably assembled into the second unit such that lateral vibration of the bearing block is supported by the second unit, and a sealing structure is provided in a very small gap formed between the opposing surfaces of the first and second units.

7. A pump system comprising: a first unit and a second unit; the first unit consisting of: a rotary shaft of the pump penetrating an upper structure and extending toward the second unit without a continuous surrounding wall; an impeller mounted to the rotary shaft; a bearing for supporting the rotary shaft at a point above the impeller; and a bearing block to which the bearing is mounted; the second unit consisting of: a diffuser for accepting the fluid from the fluid delivery port of the impeller; and a delivery pipe for leading the fluid coming out of the fluid delivery port of the diffuser toward the outside of the pump; whereby the second unit is supported independently of the first unit at a position lower than the rotary shaft, the first unit is removably assembled into the second unit such that lateral vibration of the bearing block is supported by the second unit, and the first unit is also connected to the upper structure by circumferentially spaced support members defining a fluid passage.

8. A pump system comprising: a first unit and a second unit; the first unit consisting of: a rotary shaft of the pump penetrating an upper structure and extending without a continuous enclosure; an impeller mounted to the rotary shaft; a bearing for supporting the rotary shaft at a point above the impeller; and a bearing block to which the bearing is mounted; the second unit consisting of: a diffuser for accepting the fluid from the fluid delivery port of the impeller; and a delivery pipe for leading the fluid coming out of the fluid delivery port of the diffuser toward the outside of the pump; whereby the second unit is supported independently of the first unit at a position lower than the rotary shaft, the first unit is removably assembled into the second unit such that lateral vibration of the bearing block is supported by the second unit, and the first unit is also connected to the upper structure by at least one support member defining a fluid passage.

9. A pump system comprising; a first unit and a second unit; the first unit consisting of: an unencased rotary shaft of the pump penetrating an upper structure; an impeller mounted to the rotary shaft; a bearing for supporting the rotary shaft at a point above the impeller; and a bearing block to which the bearing is mounted; the second unit consisting of: a diffuser for accepting the fluid from the fluid delivery port of the impeller; and a delivery pipe for leading the fluid coming out of the fluid delivery port of the diffuser toward the outside of the pump; whereby the second unit is supported independently of the first unit at a position lower than the rotary shaft and the first unit is removably assembled into the second unit such that lateral vibration of the bearing block is supported by the second unit.

10. A pump for sue in a reactor vessel comprising: a first unit and a second unit; the first unit consisting of: a pump rotary shaft penetrating an upper structure and free of a continuous casing therearound; an impeller mounted to the rotary shaft; a bearing for supporting the rotary shaft at a point above the impeller; and a bearing block to which the bearing is mounted; the second unit

* * * * *